US005495145A

United States Patent [19]

Pingree, Jr.

[11] Patent Number: 5,495,145

[45] Date of Patent: Feb. 27, 1996

[54] PSEUDO-SPRING LOADING MECHANISM FOR MAGNETRON TUNER

[75] Inventor: Richard E. Pingree, Jr., South Williamsport, Pa.

[73] Assignee: Litton Systems, Inc., Woodland Hills, Calif.

[21] Appl. No.: 273,866

[22] Filed: Jul. 12, 1994

[51] Int. Cl.[6] ..... H01J 23/213

[52] U.S. Cl. ..... 315/39.61; 331/90

[58] Field of Search ..... 315/39.51, 39.55, 315/39.61; 331/90

[56] References Cited

U.S. PATENT DOCUMENTS

| | | | |
|---|---|---|---|
| 2,542,908 | 2/1951 | Derby | 315/39.61 |
| 2,625,669 | 1/1953 | Anderson | 315/39.61 |
| 2,834,916 | 5/1958 | Briggs | 315/39.61 |
| 2,878,415 | 3/1959 | Gormley et al. | 315/39.61 X |
| 3,441,795 | 4/1969 | Hynes et al. | 315/39.61 |
| 3,541,479 | 11/1970 | Webb | 315/39.61 X |
| 3,564,340 | 2/1971 | Bahr | 315/39.61 |
| 4,313,091 | 1/1982 | Busacca et al. | 315/39.61 X |
| 4,527,094 | 7/1985 | Gerard et al. | 315/39.61 X |
| 4,531,104 | 7/1985 | Schaeffer | 331/90 |

OTHER PUBLICATIONS

Microwave Tubes, by A. S. Gilmour, Jr., "Artech House", pp. 368–373.

*Primary Examiner*—Benny T. Lee

[57] ABSTRACT

A apparatus for tuning a resonant cavity of a magnetron is provided which prevents undesired frequency fluctuation during thermal cycling or vibration. The magnetron has an axially disposed resonant cavity comprising a plurality of radially disposed anode vanes. Alternating ones of the vanes are electrically connected together by a first and a second strap, respectively. The tuning apparatus comprises a tuner shaft having a threaded outside diameter, a vertical gear having a threaded inside diameter engaging the threaded outside diameter of the tuner shaft, and a worm gear engaging the vertical gear. Rotation of the worm gear translates to axial movement of the tuner shaft. A ceramic cylinder is coupled to the tuner shaft at an end adjacent to the resonant cavity, and extends into a space defined between the first and second straps by the axial movement of the tuner shaft. Disposition of the ceramic cylinder within the space alters capacitance measurable between the straps. An axial loading force is applied to the tuner shaft to prevent undesired axial movement of the tuner shaft by spring washers mechanically coupled to the tuning shaft. A base plate is secured to the tuning shaft, and the spring washers extend between the baseplate and an end portion of the magnetron. The spring washers may be disposed in series, or a plurality of stacks of spring washers may be disposed in parallel with the stacks disposed in series.

18 Claims, 2 Drawing Sheets

PSEUDO-SPRING LOADING MECHANISM FOR MAGNETRON TUNER

GOVERNMENT CONTRACT

This invention was conceived and reduced to practice under contract with the United States Government, Contract No. DAAB07-89-C-P031, which is entitled to certain rights in the invention.

BACKGROUND OF THE INVENTION

1. Field of the Invention

This invention relates to frequency tunable magnetrons, and more particularly, to a tuning mechanism utilizing spring loading to overcome frictional forces which vary with temperature during testing.

2. Description of Related Art

Crossed-field tubes, such as magnetrons, are commonly used to generate RF or microwave electromagnetic energy for assorted applications such as radar. A magnetron commonly has a cylindrically shaped cathode coaxially disposed within an anode comprising a plurality of radially extending anode vanes. Alternating ones of the vanes may be electrically connected together by straps. The space between the cathode surface and the anode provides a cavity, and a potential is applied between the cathode and the anode forming an electric field across the cavity. A magnetic field is also provided in the cavity perpendicular to the electric field. Electrons emitted thermionically from the cathode surface are caused to orbit around the cathode in the cavity due to the crossed electric and magnetic fields, and the orbiting electrons interact with an RF electromagnetic wave moving on the anode. The electrons give off energy to the moving RF wave, thus producing a high power microwave output signal.

It is useful to provide a magnetron having a frequency which can be tuned, in order to calibrate the magnetron for a desired operational frequency. Many techniques are used for tuning magnetrons, and typically employ changes in the capacitance or the inductance of the magnetron cavity. An example of a prior art tuning device for a coaxial magnetron is found in U.S. Pat. No. 4,531,104 for TUNABLE MAGNETRON OF THE COAXIAL-VACUUM TYPE, which issued Jul. 23, 1985, by Schaeffer.

In a magnetron having alternating ones of the anode vanes electrically connected together by a first and a second strap, respectively, tuning may be achieved by altering the capacitance between the straps. In such a magnetron, the anode vanes are configured to define a space between the straps, and a nonconductive tuning element, such as a ceramic cylinder, moved into a portion of the space. The capacitance between the straps is altered by the introduction of the tuning element, and accordingly, a resonant characteristic of the cavity is changed and tuning of the resonant frequency of the magnetron can be accomplished. In practice, relatively small changes in tuning element position can yield substantial changes in resonant frequency; in one such magnetron, for every 0.001 inch that the tuning element is inserted between the straps, the resonant frequency changes 18.6 MHz. Thus, accurate control of the tuning element position is critical.

There are various techniques for positioning tuning elements within the resonant cavity. The tuning element can be disposed at an end of a tuner shaft having a threaded outside diameter. A vertical gear having a threaded inside diameter concentrically engages the threaded outside diameter of the tuner shaft, such that the vertical gear and tuner shaft share a common rotational axis. Rotation of the vertical gear causes the tuner shaft to move in the axial direction. A worm gear engages the vertical gear, and rotation of the worm gear translates into axial movement of the tuner shaft. The worm gear can then be manually rotated to achieve the desired position for the tuning element, and the desired resonant frequency. Alternatively, the movement can be controlled by an electromechanical device, such as a motor.

A drawback of this type of tuning mechanism is that it is susceptible to positional variations due to environmental considerations. During qualification and acceptance of magnetrons for governmental use, the magnetrons are exposed to wide temperature changes and mechanical vibrations, commonly known as "shake and bake" testing. Ideally, the tuning element should maintain its position throughout the test range; according to a government specification, the frequency can not deviate more that 2 MHz from the original reading, thus the tuning element position could not deviate more than 0.000107075 inch from its original setting. In actual practice, however, it is difficult to control the position with the required degree of accuracy.

The position fluctuation is due, in part, to space provided between a threaded shaft sleeve coupled to the tuner shaft, and a bellows retainer. The engagement between the shaft sleeve and the bellows retainer must be tight, otherwise any play between the two members would translate to undesired movement of the tuning element. If the coupling between the two members is too tight, however, the torque required to overcome the frictional forces between the members becomes too great to permit fine adjustment of the tuning element position.

Accordingly, it would be desirable to provide a tuning mechanism for a magnetron that provides adequate frequency stability without the need for excessive torque to operate the moveable tuning element.

SUMMARY OF THE INVENTION

In accordance with the teachings of this invention, a low-torque, frequency stable tuning apparatus for a magnetron is provided. The magnetron has an axially disposed resonant cavity comprising a plurality of radially disposed anode vanes. Alternating ones of the vanes are electrically connected together by a first and a second strap, respectively. A tuning element is extended into a space between the first and second straps to alter a resonant characteristic of the magnetron resonant cavity.

The tuning apparatus of this invention comprises a tuner shaft having a threaded outside diameter, a vertical gear having a threaded inside diameter in mesh with the threaded outside diameter of the tuner shaft, and a worm gear in mesh with the vertical gear. Rotation of the worm gear translates to axial movement of the tuner shaft. The tuning element is coupled to the tuner shaft at an end adjacent to the resonant cavity, and extends into the space defined between the first and second straps by the axial movement of the tuner shaft. An axial loading force is applied to the tuner shaft to prevent undesired axial movement of the tuner shaft by spring washers mechanically coupled to the tuner shaft. A base plate is secured to the tuner shaft, and the spring washers extend between the base plate and an end portion of the magnetron. The spring washers may be disposed in series, or a plurality of stacks of spring washers may be disposed in parallel with the stacks disposed in series.

A more complete understanding of the pseudo-spring loading mechanism for a magnetron tuner will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

This invention provides a tuning mechanism for a magnetron that enables adequate frequency stability without the need for excessive torque to operate the moveable tuning element. In the description which follows, like numerals are used to define individual elements of the invention and prior art that are the same and which are illustrated in one or more of the figures.

Figure 1:
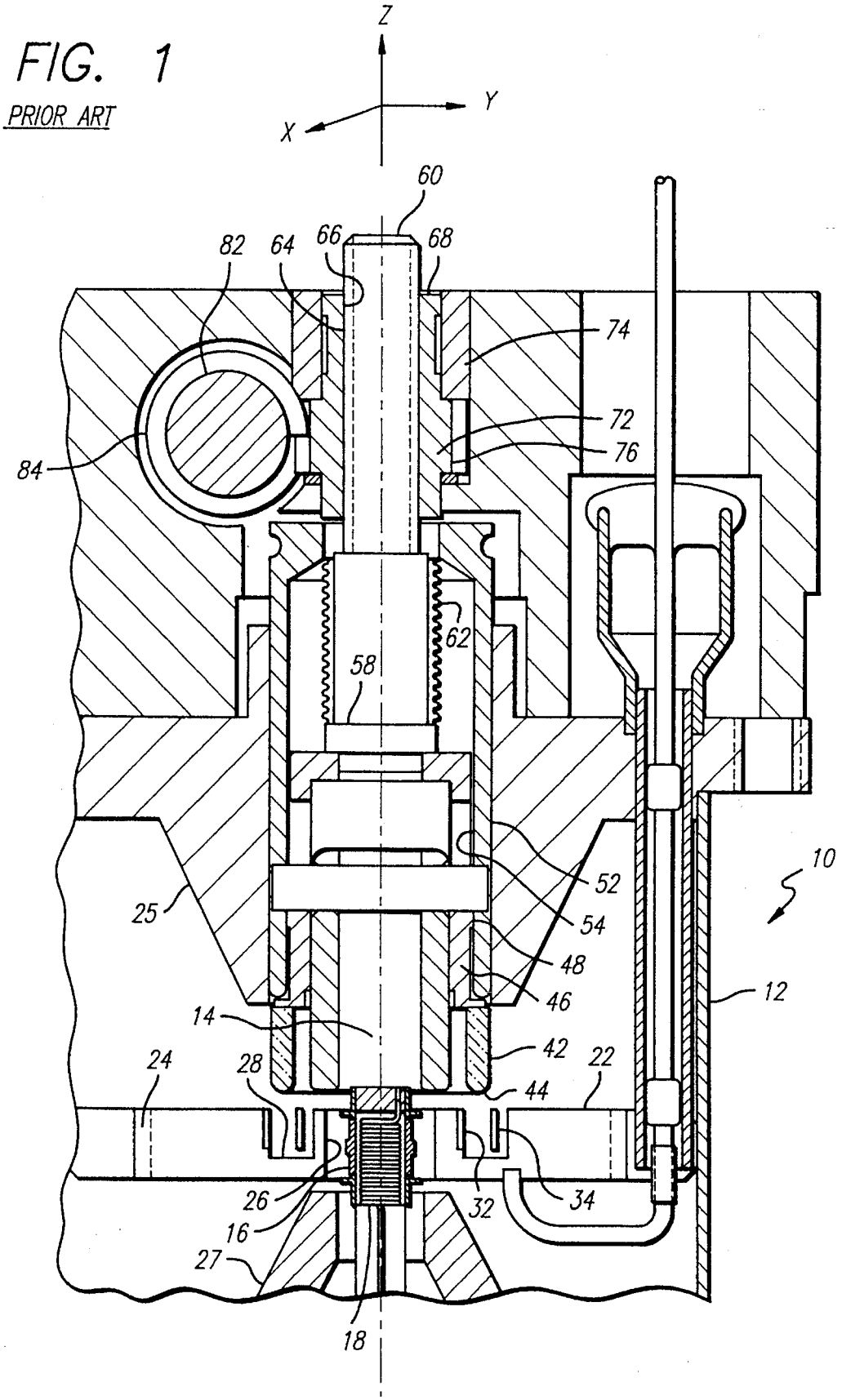
FIG. 1 PRIOR ART
FIG. 1 is a sectional side view of a prior art magnetron tuning mechanism.

Referring first to FIG. 1, a sectional side view of a prior art magnetron tuning mechanism is illustrated. The magnetron 10 is disposed within an external housing 12 having a preselected volume for a particular application. The magnetron 10 has a cathode coaxially disposed with a central axis 14 of the magnetron. The cathode is cylindrically shaped and comprises a thermionic emitting surface 16 and an internal heater coil 18. The cathode surface 16 is concentrically disposed within an anode structure that comprises a plurality of radial anode vanes 22 that extend inward toward the cathode from an anode ring 24. The cathode surface 16 operates at a highly negative potential relative to the anode structure, such that an electric field is defined in a cavity between the cathode surface 16 and the innermost tips 26 of the vanes 22.

Magnetic polepieces 25 and 27 are disposed above and below the anode vanes 22, respectively. The polepieces 25, 27 conduct magnetic flux to the cavity to provide a magnetic field which crosses the electric field. Electrons are thermionically emitted from the cathode surface 16 that orbit around the cathode by interaction with the crossed electric and magnetic fields within the cavity. The orbiting electrons interact with an RF electromagnetic wave traveling on the vane structure, transferring energy to the RF wave.

The resonant frequency of the magnetron 10 is determined by the inductance and capacitance of the cavity. Cavity capacitance is defined, in part, by coupling between adjacent ones of the anode vanes 22. Inner strap 32 and outer strap 34 electrically couple alternating ones of the vanes 22 so that they operate at substantially the same potential. A notch 28 is defined in a portion of the vanes 22 to permit the straps 32, 34 to couple alternating vanes without electrically contacting adjacent vanes. The disposition of the straps 32, 34 in facing engagement permits capacitive coupling between the vanes. Thus, the interposition of a tuning element into the space defined by the notch 28 between the vanes 32, 34 alters the capacitive coupling, and accordingly, the resonant frequency of the magnetron can be varied.

A tuning element 42 is used to control the coupling capacitance between the straps 32, 34. The tuning element 42 has a cylindrical shape with a rounded end 44 that can be selectively extended into the space defined by the notch 28. It is anticipated that the tuning element 42 is to be be comprised of an electrically nonconductive, thermally rugged material, such as ceramic.

The tuning element 42 is mechanically coupled to a shaft sleeve 46 having an outside diameter 48. The shaft sleeve 46 is disposed within a bellows retainer 52 having an inside diameter 54 that frictionally engages the outside diameter 48 of the shaft sleeve. The bellows retainer 52 remains in a fixed position relative to the cavity, and the shaft sleeve 46 moves axially relative to the bellows retainer.

The shaft sleeve 46 receives axial force from an end 58 of a tuner shaft 60 coaxially disposed along the axis 14. A bellows 62 provides a seal between the vacuum environment within the magnetron 10, and the non-vacuum environment outside the magnetron. The bellows 62 has a plurality of pleats that permit expansion or contraction of the bellows as the tuner shaft 60 extends into and out of the magnetron 10.

The tuner shaft 60 has a threaded outside diameter 64 that meshes with a threaded inside diameter 66 of a vertical gear 68. The vertical gear 68 has an outwardly extending waist portion 72 that is disposed below a gear retainer 74 disposed in the magnetron housing structure. Rotation of the vertical gear 68 translates to axial motion of the tuner shaft 60, and the vertical gear is precluded from moving axially by the interaction between the waist portion 72 and the gear retainer 74. An outside diameter surface 76 of the waist portion 72 has vertical threads which mesh with a threaded surface 84 of a worm gear 82. The worm gear 82 has an end (not shown) that permits manual rotation of the worm, such as by a screwdriver or wrench. Thus, selective rotation of the worm gear 82 translates into axial movement of the tuner shaft 60 through the vertical gear 68, that in turn translates to axial movement of the tuning element 42.

As described above, the axial position of the tuning element 42 is critical to frequency stability of the magnetron 10. Both lateral (x and y-axis) and axial (z-axis) movement of the tuning element 42 within the cavity can significantly and adversely affect the resonant frequency. To avoid such deleterious effects, extremely tight engagement between the shaft sleeve 46 and bellows retainer 52 is provided. This way, lateral and/or axial movement of the tuning element 42 during thermal and vibration testing is minimized. The extent to which the engagement between the shaft sleeve 46 and bellows retainer 52 can be made tight is limited by the magnitude of drive torque required to axially move the shaft sleeve relative to the bellows retainer. Also, during temperature cycling, the tuning element 42 is designed to naturally move in response to thermal expansion in order to frequency compensate for dimensional changes in the resonator cavities. Upon return to ambient temperature, however, the frictional force between the shaft sleeve 46 and bellows retainer 52 increases, resulting in the tuning element not returning to its original position.

Figure 3:
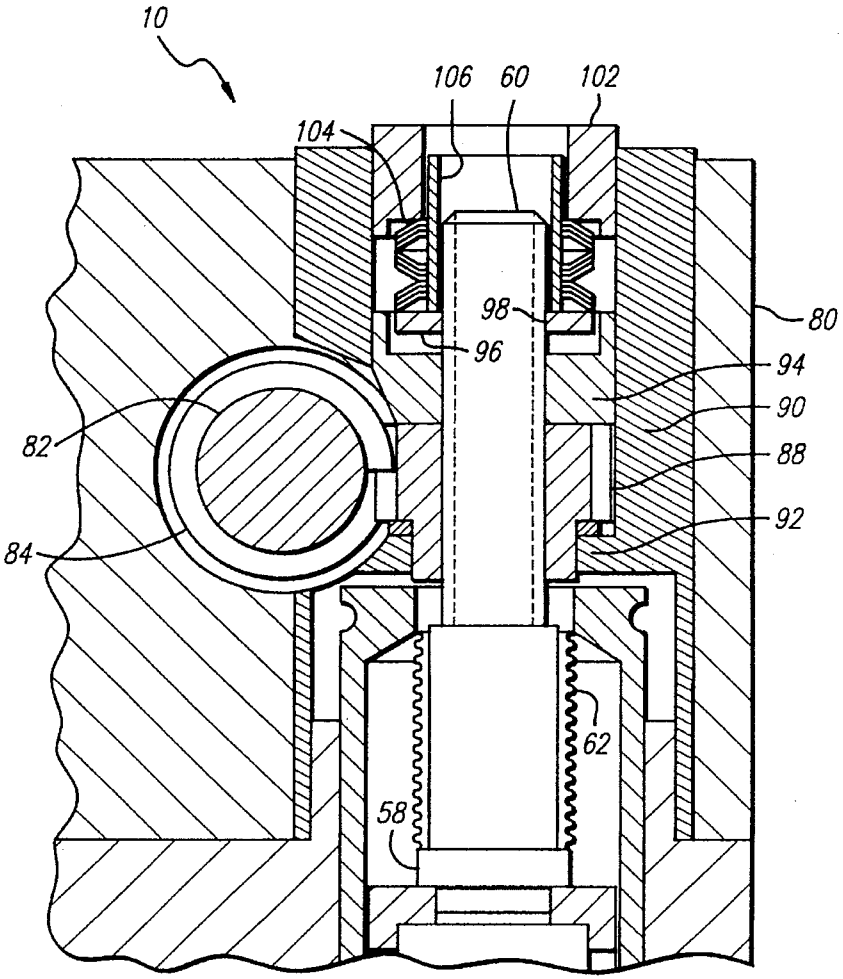
FIG. 3 is a sectional side view of a second embodiment of a pseudo-spring tuning mechanism.
Figure 2:
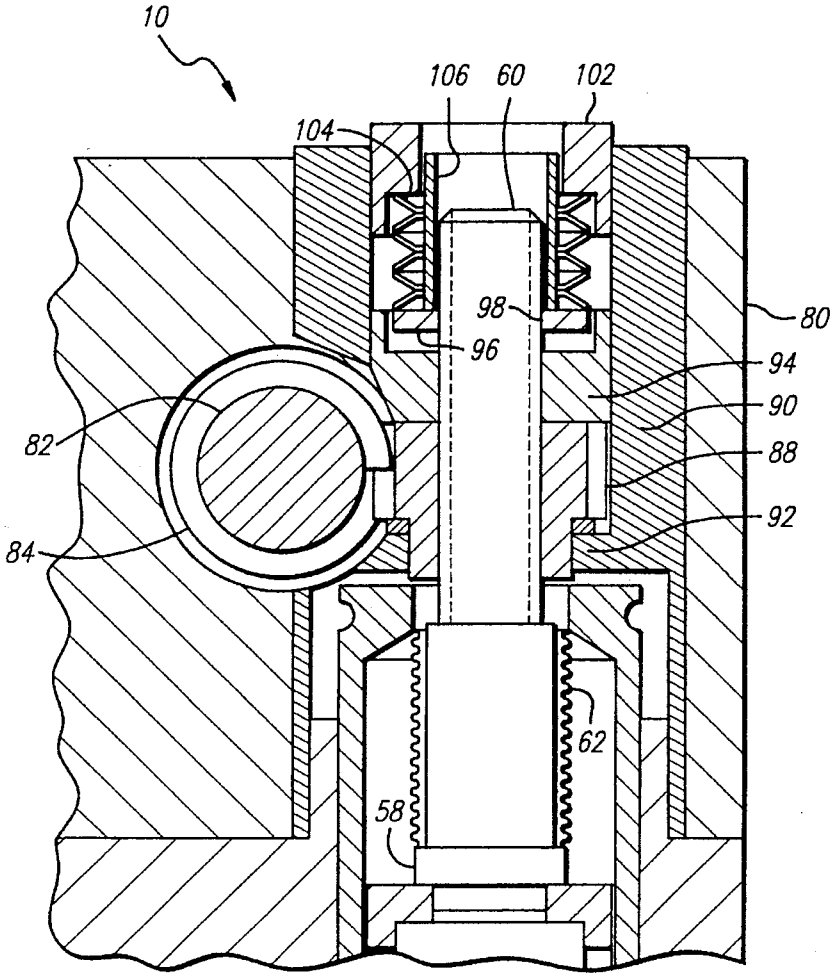
FIG. 2 is a sectional side view of a first embodiment of pseudo-spring tuning mechanism of this invention.

This problem is effectively solved in this invention. Referring now to FIGS. 2 and 3, a magnetron tuning apparatus of the present invention is illustrated. As in the prior art magnetron tuning apparatus, a tuner shaft 60 provides axial displacement to the shaft sleeve 46 for translation to the tuning element 42 as seen in FIG. 1. In the invention, axial loading is provided to the tuner shaft 60 which precludes movement of the shaft during thermal cycling or vibration, reducing the need for tight engagement between the shaft sleeve 46 and bellows retainer sleeve 52 as seen in FIG 2. Moreover, the axial loading multiplies the drive torque such that axial movement of the tuner shaft by rotation of the worm gear is facilitated.

As particularly seen in FIGS. 2 and 3, the worm gear 82 has a threaded surface 84 that in mesh with a vertical gear 88. Unlike the vertical gear 68 of the prior art magnetron tuning mechanism, the vertical gear 88 has a uniform height equivalent to the waist portion 72 described above and to FIG. 1. Axial movement of the vertical gear 88 is prevented by use of a retaining collar 92 disposed below the vertical gear, and a retaining washer 94 disposed above the vertical gear. The retaining collar 92 comprises a portion of a sleeve 90 that is secured within a housing 80 of the magnetron 10 by brazing or welding. The retaining washer 94 threadingly engages the sleeve 90. The use of the sleeve 90 insures concentricity of the tuning apparatus with respect to the tuner shaft 60.

A disk-shaped base plate 96 having a threaded inside diameter surface 98 is threaded onto the tuner shaft 60 to a desired height, then secured in place. The base plate 96 may be tacked to the tuner shaft 60 by known technique, such as brazing or welding. A space is provided between an upward facing surface of the base plate 96, and the downward facing surface of a second retaining washer 102. The space allows for the use of a loading spring to provide an axial load on the tuner shaft 60. Since it is desirable to maintain the magnetron 10 within the preselected volume, however, the vertical distance provided by the space is actually rather small (on the order of 0.125 inch). This small vertical space renders most types of loading spring impractical, as such springs do not provide sufficient load force over such a small range of motion.

A spring washer 104 does provide sufficient load force over a small vertical space. Spring washers, also known as Belleville washers, have high load deflection over low height. The spring washers have a generally conical shape with a center hole permitting installation over the tuner shaft 60. The spring washers may be stacked either in series, or in parallel, or a combination of both series and parallel. Stacking the spring washers in series increases the deflection in proportion to the number of washers, while stacking in parallel increases the load in proportion to the number of washers. The spring washers are comprised of stainless steel and are very thin (up to 0.072 inch).

In FIG. 2, six spring washers 104 are stacked in series within the space. Being in series means that the spring washers are arranged with an inside circumference of a first spring washer adjoining an inside circumference of a second spring washer, and an outside circumference of the second spring washer adjoining an outside circumference of a third spring washer, and continuing in like fashion. This embodiment would permit a relatively wide range of spring deflection for magnetron applications requiring a correspondingly wide range of tuning frequencies. Alternatively, FIG. 3 illustrates an embodiment of nine spring washers 104, with three parallel stacks of three washers each disposed in series. Being in parallel means that the spring washers are arranged with a plurality of adjoining spring washers all facing in a same direction. Friction between the parallel stacked washers causes hysteresis in the load deflection characteristics of the washers. Accordingly, this embodiment would enable less deflection, but would apply a greater load force. Thus, the second embodiment is generally preferred in that it provides sufficient deflection to achieve an acceptable tuning range for the magnetron while providing enough load to be effective.

To prevent the inside diameters of the spring washers 104 from becoming entangled in the threads of the moving tuner shaft 60, a washer guide sleeve 106 is provided. The washer guide sleeve 106 is secured to the upward facing surface of the base plate 96, and has an outside diameter slightly less than the inside diameter of the spring washers 104.

Having thus described a preferred embodiment of pseudo-spring loading mechanism for a magnetron tuner, it should be apparent to those skilled in the art that certain advantages of the within system have been achieved. It should also be appreciated that various modifications, adaptations, and alternative embodiments thereof may be made within the scope and spirit of the present invention. For example, a particular arrangement of spring washers is shown to satisfy particular operational requirements of a magnetron, but it should be apparent that the inventive concepts described above would be equally applicable to embodiments utilizing different numbers of spring washers in various series and/or parallel configurations. The invention is further defined by the following claims.

What is claimed is:

1. An apparatus for tuning an axially disposed resonant cavity of a magnetron, the apparatus comprising:

a tuner shaft and means for manipulating said tuner shaft in an axial direction relative to said cavity;

means coupled to said tuner shaft for tuning a resonant characteristic of said cavity by axially moving in cooperation with said tuner shaft into said cavity; and means coupled to said tuner shaft for loading said tuner shaft with an axial force to prevent undesired axial movement of said tuner shaft, said loading means comprising at least one stack of spring washers disposed between an axial end of said magnetron and a base plate coupled to said tuner shaft, said at least one stack comprising a plurality of washers disposed in parallel.

2. The apparatus of claim 1, wherein said manipulating means further comprises:

a worm gear;

a vertical gear in mesh with said worm gear, said vertical gear having a threaded inside circumference, said tuner shaft having a threaded outside circumference in mesh with said threaded inside circumference of said vertical gear;

whereby, rotation of said worm gear translates to axial movement of said tuner shaft.

3. The apparatus of claim 1, wherein said tuning means further comprises a ceramic cylinder, said resonant cavity comprising a plurality of radially disposed anode vanes relative to said axial direction, alternating ones of said vanes being electrically connected by a first and a second strap, respectively, said ceramic cylinder being movable in said axial direction within a space defined between said first and second straps, wherein, insertion of said ceramic cylinder into said space alters a capacitance defined between said straps.

4. The apparatus of claim 1, wherein each one of said spring washers has a conical shape and a spring bias.

5. The apparatus of claim 4, wherein said at least one stack of spring washers further comprises a plurality of said stacks of parallel washers disposed in series.

6. The apparatus of claim 1, further comprising a washer guide sleeve coupled to said base plate and extending between an inside circumference of said spring washers and said tuner shaft.

7. An apparatus for tuning an axially disposed resonant cavity of a magnetron, said cavity comprising a plurality of radially disposed anode vanes with alternating ones of said vanes being electrically connected together by a first and a second strap, respectively, said apparatus comprising:

a tuner shaft having a threaded outside circumference, a vertical gear having a threaded inside circumference in mesh with said threaded outside circumference of said tuner shaft, and a worm gear in mesh with said vertical gear, wherein rotation of said worm gear translates to axial movement of said tuner shaft;

a ceramic cylinder coupled to said tuner shaft at an end thereof adjacent to said resonant cavity, said ceramic cylinder being extended from said tuner shaft into a space defined between said first and second straps by said axial movement of said tuner shaft; and means coupled to said tuner shaft for applying an axial loading force to said tuner shaft to prevent undesired axial movement of said tuner shaft, said means comprising at least one stack of spring washers mechanically coupled to said tuning shaft, said at least one stack comprising a plurality of spring washers disposed in parallel;

whereby, disposition of said ceramic cylinder within said space alters a capacitance defined between said straps.

8. The apparatus of claim 7, further comprising a base plate coupled to said tuning shaft, said at least one stack of spring washers extending between said base plate and an end portion of said magnetron.

9. The apparatus of claim 8, further comprising a washer guide sleeve connected to said base plate and extending between an inside circumference of said washers and said tuner shaft.

10. The apparatus of claim 7, wherein each one of said spring washers has a conical shape and a spring bias.

11. The apparatus of claim 7, wherein said at least one stack of spring washers further comprises a plurality of said stacks of parallel disposed in series.

12. An apparatus for tuning a resonant cavity of a crossed-field tube, said apparatus comprising:

a tuner shaft having a threaded outside circumference, a vertical gear having a threaded inside circumference in mesh with said threaded outside circumference of said tuner shaft, and a worm gear in mesh with said vertical gear such that rotation of said worm gear translates to linear movement of said tuner shaft;

means coupled to said tuner shaft at an end thereof adjacent to said resonant cavity for altering a resonant characteristic of said resonant cavity by extending said means linearly from said tuner shaft into said resonant cavity; and at least one stack of spring washers mechanically coupled to said tuner shaft, said spring washers of said at least one stack being disposed in parallel, said at least one stack of spring washers applying a loading force to said tuner shaft to prevent undesired movement of said tuner shaft.

13. The apparatus of claim 12, wherein said at least one spring washer has a conical shape, and a spring bias.

14. The apparatus of claim 12, further comprising a base plate coupled to said tuning shaft, said at least one stack of spring washers extending between said base plate and an end portion of said crossed-field tube.

15. The apparatus of claim 14, further comprising a washer guide sleeve connected to said base plate and extending between an inside circumference of said washers and said tuner shaft.

16. The apparatus of claim 12, wherein said at least one stack of spring washers further comprises a plurality of said stacks of parallel washers disposed in series.

17. An apparatus for tuning a resonant cavity of a crossed-field tube, said apparatus comprising:

a tuner shaft having a threaded outside circumference, a vertical gear having a threaded inside circumference in mesh with said threaded outside circumference of said tuner shaft, and a worm gear in mesh with said vertical gear such that rotation of said worm gear translates to axial movement of said tuner shaft;

a ceramic cylinder coupled to said tuner shaft at an end thereof adjacent to said resonant cavity, said ceramic cylinder being extended from said tuner shaft into said resonant cavity by said axial movement of said tuner shaft;

a base plate coupled to said tuner shaft;

a plurality of spring washers extending between said base plate and an end portion of said tuner shaft, said plurality of spring washers each having a conical shape and a spring bias, each of said plurality of spring washers being disposed in series, said plurality of spring washers applying a loading force to said tuner shaft to prevent undesired movement of said tuner shaft; and a washer guide sleeve coupled to said base plate and extending between an inside circumference of said plurality of spring washers and said tuner shaft.

18. An apparatus for tuning a resonant cavity of a crossed-field tube, said apparatus comprising:

a tuner shaft having a threaded outside circumference, a vertical gear having a threaded inside circumference in mesh with said threaded outside circumference of said tuner shaft, and a worm gear in mesh with said vertical gear such that rotation of said worm gear translates to axial movement of said tuner shaft;

a ceramic cylinder coupled to said tuner shaft at an end thereof adjacent to said resonant cavity, said ceramic cylinder being extended from said tuner shaft into said resonant cavity by said axial movement of said tuner shaft;

a base plate coupled to said tuner shaft;

at least one stack of spring washers extending between said base plate and an end portion of said tuner shaft, said spring washers of said at least one stack being disposed in parallel, each one of said spring washers having a conical shape and a spring bias, said at least one stack applying a loading force to said tuner shaft to prevent undesired movement of said tuner shaft; and a washer guide sleeve coupled to said base plate and extending between an inside circumference of said at least one stack and said tuner shaft.

* * * * *